US006007307A

United States Patent [19]

Sonoda

[11] Patent Number: 6,007,307

[45] Date of Patent: Dec. 28, 1999

[54] AIR PUMP WITH NOISE REDUCTION PARTITIONS IN THE HOUSING

[75] Inventor: Yoshiteru Sonoda, Osaka, Japan

[73] Assignee: Fujikin Incorporated, Osaka, Japan

[21] Appl. No.: 08/976,490

[22] Filed: Nov. 24, 1997

[30] Foreign Application Priority Data

Nov. 26, 1996 [JP] Japan ..... 8-314392

[51] Int. Cl.[6] ..... F04B 43/00

[52] U.S. Cl. ..... 417/312; 417/413.1

[58] Field of Search ..... 417/312, 313, 417/413, 413.1

[56] References Cited

U.S. PATENT DOCUMENTS

| | | | |
|---|---|---|---|
| 3,825,374 | 7/1974 | Kondo | 417/413.1 |
| 3,830,596 | 8/1974 | Kondo | 417/413.1 |
| 5,009,579 | 4/1991 | Grant | 417/413.1 |
| 5,137,432 | 8/1992 | Tsai | 417/312 |
| 5,360,323 | 11/1994 | Hsieh | 417/413.1 |
| 5,711,656 | 1/1998 | Tsai | 417/312 |

*Primary Examiner*—Charles G. Freay
*Assistant Examiner*—Robert Z. Evora
*Attorney, Agent, or Firm*—Griffin, Butler, Whisenhunt & Szipl, LLP

[57] ABSTRACT

An air pump comprises a diaphragm pump with a diaphragm connected to a vibrator driven by an electromagnet. The air pump has a main casing body divided into three chambers: an air pump chamber which houses the electromagnet, vibrator and diaphragm pump; a sucked air noise reduction chamber into which air is sucked from outside the casing as the volume of the diaphragm chamber of the diaphragm pump is expanded; and a discharged air noise reduction chamber through which air is discharged to the exterior of the casing as the volume of the diaphragm chamber is decreased. A first air passage connects the sucked air noise reduction chamber to an inlet opening of the diaphragm chamber and a second air passage connects an outlet opening of the diaphragm chamber to the discharged air noise reduction chamber. A portion of the noise resulting from operation of the diaphragm and the inlet and outlet valves to the diaphragm chamber is propagated from the diaphragm chamber through air in the first and second air passages and is reduced as the sound waves expand upon entering the noise reduction chambers. In a second embodiment the main casing body is divided into only two chambers and the electromagnet, vibrator and diaphragm pump are disposed in one or the other of these chambers.

5 Claims, 9 Drawing Sheets

AIR PUMP WITH NOISE REDUCTION PARTITIONS IN THE HOUSING

FIELD OF THE INVENTION

The present invention relates to air pumps of the type used for supplying fresh air to water in a tank holding fish, aquatic plants, etc. The invention provides an expansion type silencing chamber in the pump casing to substantially reduce noise transferred to the surrounding environment during operation of the pump.

BACKGROUND OF THE INVENTION

It is well known to provide tanks, generally referred to as fish tanks, having transparent walls so that fish, swimming in water in the tanks, may be observed from the exterior of the tank. The fish may be bred, grown or maintained as a hobby, or tanks containing the fish may be displayed for their decorative or aesthetic effect to enhance the ambience of a home, office or place of public accommodation such as a hotel, motel, etc. The fish require oxygen for survival so an air pump is provided for supplying fresh air to the water.

FIGS. 11 and 12 show one example of an air pump P presently used to feed air into the water contained in a fish tank. The pump casing 1A comprises a plastic main casing body 1, open at the bottom side as viewed in FIG. 12, and a cover 6 detachably fitted to the casing body 1 so as to close the bottom side. Disposed within the casing body are an electromagnet 2, a vibrator in the form of an arm 4 mounted on a support 10 and having a permanent magnet 3 fixed to one end, and an elastic diaphragm member 5*a* made of rubber and interfitted with a second member 5*d* to form a pump chamber 5*e*. Member 5*d* is provided with an inlet valve 5*b* connected to an air suction opening 8 and a discharge valve 5*c* connected to an air discharge opening 9. The vibrator arm 4 is fastened to the diaphragm member 5*a*.

When an alternating voltage is applied through the power supply cord 11, the electromagnet 2 is actuated and the vibrator arm 4 vibrates, as indicated by the double-headed arrow in FIG. 12, as a result of the electromagnetic forces acting between the electromagnet 2 and the permanent magnet 3. As arm 4 vibrates, it moves the diaphragm member 5*a* fastened thereto so that the volume of the pump chamber 5*e* alternately increases and decreases and air in the chamber is alternately expanded and compressed. During the time of the expansion, the inlet valve 5*b* is opened and the discharge valve 5*c* is closed so that air A is sucked into the diaphragm chamber 5*e* from the interior of the casing. An air inlet 7 in the casing cover 6 permits entry of replacement air into the casing. During the time of the compression, the inlet valve 5*b* is closed and the discharge valve 5*c* is opened so that air in the diaphragm chamber 5*a* is discharged through the air discharge opening 9 to the outside of the casing. A flexible hose 12 conveys the discharged air to the water in a tank.

An air pump having the arrangement shown in FIGS. 11 and 12 is simple in structure, can be produced at a low price and exhibits a stable operation so that the rate of air discharge (volume per unit of time) is substantially constant. However, the air pump does have disadvantages, the most serious being that it generates considerable audible noise. When the background noise level in the surrounding environment is comparatively high, as in the lobby of a hotel in the daytime for example, the noise of the pump is not a serious problem. On the other hand, when the background noise level is low, as might be the case at night in sleeping quarters for example, the noise generated by operation of the pump becomes more noticeable. The pump thus generates noise which cannot be ignored, is irritating to those who hear it, and disturbs sleep or concentration at work or study.

Workers in the art have attempted to reduce the pump noise by various methods including (1) improving air-tightness of the casing, (2) mounting the electromagnet 2 and the components forming pump 5 to the main casing body 1 through a vibration preventing material, or (3) by a combination of improved air-tightness and improved mounting of the components. The first method, that is, improvement of the air-tightness of the casing, is the most frequently used. In this case through-holes in the casing body 1 and the cover 6, such as the through-hole for electrical leads 11, and the narrow spaces at the joint between the casing body 1 and cover 6 are filled with a sealing material such as a silicone resin. The air inlet 7, which permits entry of replacement air, can not be sealed so it is filled with a filter material 7*a* which may be glass fiber or similar material.

The above sealing arrangement considerably reduces the noise emitted into the surrounding environment by the pump P. FIGS. 13 and 14 are plots of measured acoustic pressure level in decibels versus frequency for a conventional unsealed air pump P (FIG. 13), and for the same pump sealed with a silicone resin sealing material as described above (FIG. 14). In both cases the measurements were made in an otherwise noiseless room with a silencer installed on the outlet of the pump.

Comparing FIGS. 13 and 14, it is seen that in the case of the sealed air pump P, the noise is reduced slightly at 60 Hz and greatly in a frequency range above 200 Hz. On the other hand, there is only a slight reduction of noise in the low frequency range between about 60 Hz to 200 Hz. Thus, noise abatement by the sealing arrangement does not completely solve the noise problem. In situations where the background noise level is low, such as at night in a comparatively quiet neighborhood, the noise produced by the pump is sufficiently loud to be a source of annoyance and irritation.

In the second method of reducing pump noise, the pump 5 and the electromagnet 2 are fixed to the casing body 1 through vibration-proof rubber, etc., and the cover 6, which serves as the base of the air pump, is made of rubber so that a vibration absorbing arrangement is obtained and the noise is reduced. This method reduces noise propagated through solid parts of the pump but does little to suppress noise propagated by air. When the noise of the vibration-proof type air pump P is actually measured, it is found that the noise reducing effect is similar to that of the sealed air pump. Therefore, the noise cannot be reduced to a satisfactory degree using vibration suppression in spite the large number of parts employed and the high manufacturing costs involved.

Further, the inventor of the present invention has found that in an air pump as shown in FIGS. 11 and 12, vibrations of the electromagnet 2, vibrator arm 4 and diaphragm 5*a*, do not comprise the only sources of noise. Operations of the inlet valve 5*b* and the discharge valve 5*c* also generate noise. Based on this finding he has previously invented a low-noise air pump having an arrangement such that a synthetic resin pipe about 30 to 50 cm long is provided in the casing body 1, and air introduced into the casing through the pipe is sucked into the diaphragm chamber 5*e* of the pump.

It was found that the above method using the synthetic resin hose can reduce the noise of the air pump P greatly and produce an excellent practical effect. However, in order to provide the synthetic resin hose in the casing body 1, a winding bobbin and a holding member for holding the bobbin are additionally required. Contact of the synthetic resin hose with the casing body 1 becomes a new source of noise. For this reason, the bobbin around which the synthetic resin hose is wound should be installed accurately, and thus this method has a disadvantage in that it requires great care during assembly of the pump.

The hose reduces noise at the inlet side of pump P. Since the noise at the discharge side of the pump P should be also be reduced, as by using an expansion-type silencer, accessories for the pump increase its cost.

SUMMARY OF THE INVENTION

An object of the present invention is to provide an air pump having none of the disadvantages described above.

A further object of the invention is to provide an air pump which, as compared to pumps of the prior art, transfers considerably less noise to the surrounding environment during its operation.

It is an object of the present invention to provide an air pump in which noise at frequencies ranging above and below 200 Hz is surely and greatly reduced as compare to existing air pumps.

The above objects are attained, in a first embodiment, by providing a pump casing comprising a main casing body and a cover, the interior of the main casing body being divided into two chambers designated the sucked air noise reduction chamber and the discharged air noise reduction chamber. An electromagnet, vibrator and diaphragm pump are disposed in one of the chambers. The electromagnet drives the vibrator to move the diaphragm of the diaphragm pump to alternately reduce and expand the volume of the diaphragm chamber so that air is sucked into the diaphragm chamber through an air suction opening or discharged from the diaphragm chamber through an air discharge opening. First and second air passages connect the air suction opening and air discharge opening to the sucked air noise reduction chamber and the discharged air noise reduction chamber. Air sucked into the casing through an air inlet passes through the sucked air noise reduction chamber and first air passage to the diaphragm chamber. Air discharged from the diaphragm chamber passes through the second air passage and the discharged air noise reduction chamber before being discharged from the casing. A part of the noise generated by operation of the diaphragm and inlet and outlet valves of the diaphragm pump is propagated through the first and second air passage and the noise is reduced as the sound waves disperse into the noise reduction chambers.

In a second embodiment, a third chamber is provided in the main casing body and houses the electromagnet, vibrator and diaphragm pump. The third chamber may be entirely separate from the noise reduction chambers or it may be connected to one or the other of the noise reduction chambers by a third air passages.

The air passages may be located in the walls of the main casing body and in the cover.

Other objects and advantages of the invention and the manner of making and using it will become evident upon consideration of the following description and the accompanying drawings.

DESCRIPTION OF PREFERRED EMBODIMENTS

Figure 1:
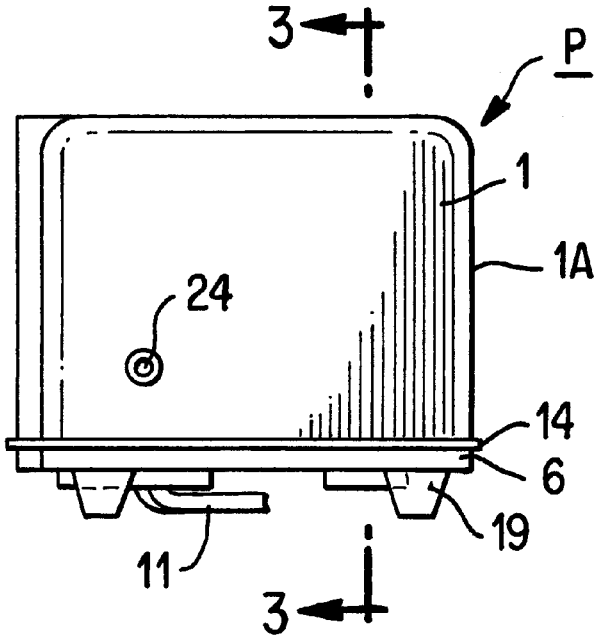
FIG. 1 is a front view of an air pump according to a first embodiment of the present invention.
Figure 6:
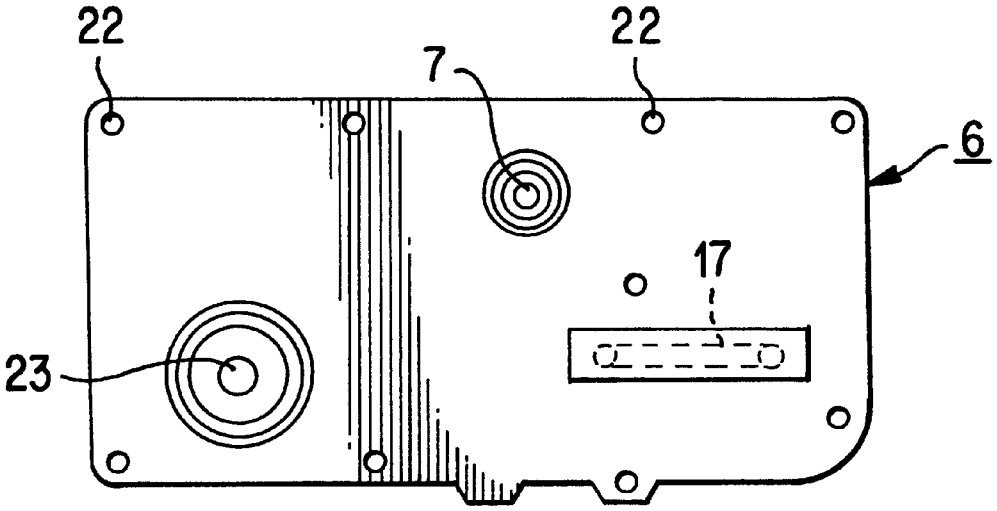
FIG. 6 is a bottom view of the casing cover.

Referring to FIGS. 1–6, a first embodiment of an air pump P according to the present invention comprises a plastic main casing body 1 having walls on all sides except the bottom, and a synthetic resin or elastic rubber cover 6 for closing the bottom of the main casing body to thus form an enclosed casing or housing 1A.

The cover 6 is provided with a plurality of through holes 22 (FIG. 6) and the main casing body 1 is provided with threaded holes 21 (FIG. 4) so that the cover may be secured to the casing body by screws (not shown). A sealing material 14 (FIG. 3) is provided between the main casing body and the cover so that an airtight seal is formed when the screws are tightened. A plurality of rubber cushions or feet 19 are provided on the bottom of cover 6 to support the pump.

An opening or air inlet 7 (FIGS. 3 and 6) is bored through cover 6 to permit air to be drawn into the casing. This opening may be provided with a filter 7*a* made of glass or synthetic fiber or other sound dispersing filter material or it may be provided with a noise-reducing structure comprising blowing (finely powdered) aluminum which has excellent noise absorption characteristics.

A further opening 23 (FIG. 7) is provided in cover 6 and a power supply cord 11 (FIG. 3) extends through this opening and is connected to an electromagnet 2.

Disposed within the casing are the electromagnet 2, a vibrator comprising a vibrator arm 4 and a permanent magnet 3 attached to one end of the arm, a diaphragm pump 5, and a support 10 for supporting the vibrator arm at the end opposite the end carrying the permanent magnet. A piece of mild steel or another magnetic material may be used in place of the permanent magnet 3.

The diaphragm pump 5 comprises a diaphragm member 5*a* (FIG. 2) secured to vibrator arm 4 by a suitable fastener 30 and a second member 5*d* secured to a side wall of casing body 1 by a second fastener 32. Diaphragm member 5*a* is elastic, that is, easily deformable, and may be made of rubber, an elastic synthetic resin or a metallic thin plate.

The members 5*a* and 5*d* together define the chamber 5*e* of the pump 5. The member 5*d* carries an inlet valve 5*b* and an outlet or discharge valve 5*c*. Inlet valve 5*b* opens to permit air to be drawn into the chamber 5*e* from an air suction opening 8 in the side wall of the casing body 1 as the vibrator arm 4 draws diaphragm member 5*a* away from member 5*d* to expand the chamber, and blocks air flow out of the chamber through opening 8 as vibrator arm 4 drives diaphragm member 5*a* toward member 5*d* to reduce the volume of the chamber. On the other hand, outlet valve 5*c* blocks air flow into the chamber 5*e* from an air discharge opening 9 in the side wall of casing body 1 as vibrator arm 4 draws diaphragm member 5*a* away from member 5*d* to expand the volume of the chamber and opens to permit discharge of air from the chamber through the air discharge opening 9 as vibrator arm 4 drives diaphragm member 5*a* toward member 5*d* to reduce the volume of the chamber.

Figure 4:
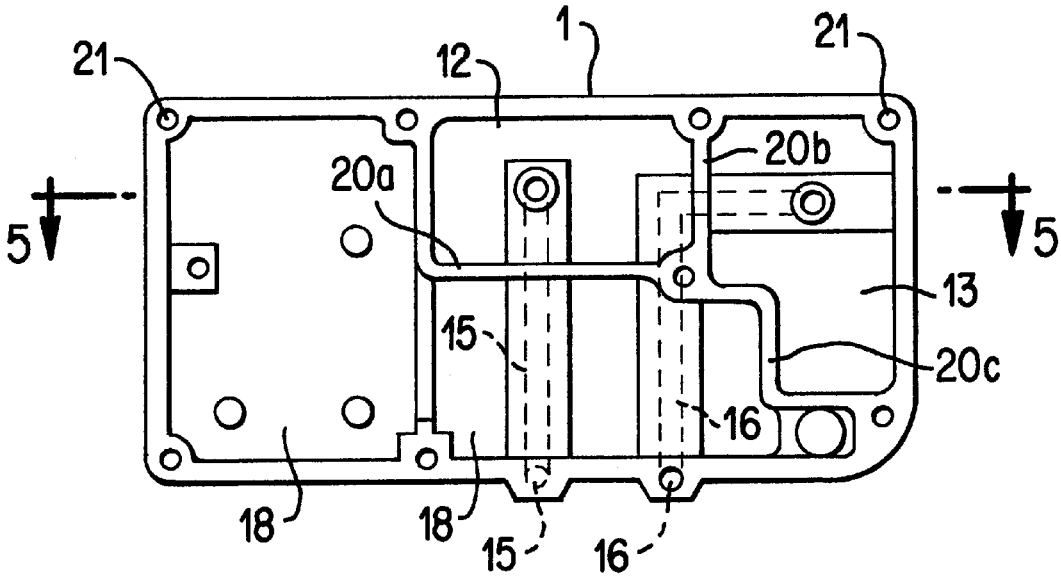
FIG. 4 is a bottom view of the main casing body.
Figure 5:
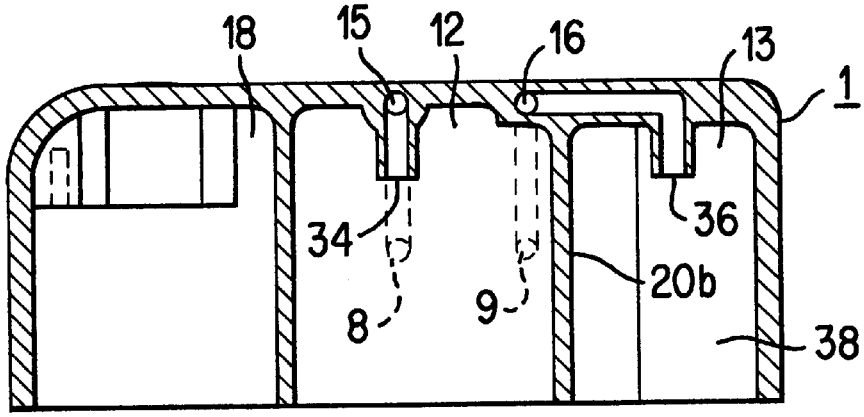
FIG. 5 is a longitudinal cross sectional view of the main casing body taken along the line 5—5 of FIG. 4.

Referring to FIGS. 4 and 5, the interior of the casing body 1 is provided with three bulkheads or divider walls 20*a*, 20*b* and 20*c* which divide the interior of the casing into first, second and third chambers or regions designated the sucked air noise reduction chamber 12, the discharged air noise reduction chamber 13 and the air pump chamber 18, respectively. Electromagnet 2, vibrator arm 4 and diaphragm pump 5 are all disposed within the chamber 18.

First and second air passages 15 and 16 are provided within the top and one side wall of the main casing body 1. The first air passage 15, designated the air suction passage, terminates at one end at an opening 34 in chamber 12 and the other end of the passage terminates at the opening 8 so that air may be drawn into pump chamber 5*e* from chamber 12 as the pump chamber is expanded. The second air passage 16, designated the discharged air passage, terminates at one end at an opening 36 in the chamber 13 and the other end of this passage terminates at the opening 9 so that air discharged from pump chamber 5*e* as the volume of the chamber is reduced may flow into the chamber 13.

The discharged air noise reduction chamber 13 may be filled with an air filter material such as glass fiber, as partially represented at 38 in FIG. 5, to provide further noise reduction.

A third air passage 17, designated the air discharge connecting passage, connects the discharged air noise reduction chamber 13 to the air pump chamber 18 when the cover 6 is attached to the main casing body 1.

Figure 2:
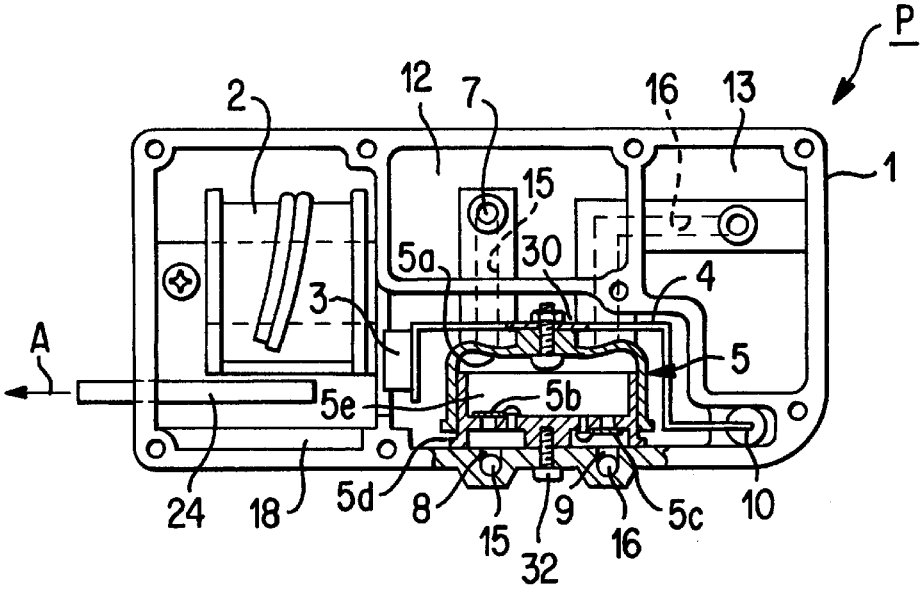
FIG. 2 is a bottom view of the air pump, partly in section, with the casing cover removed.
Figure 3:
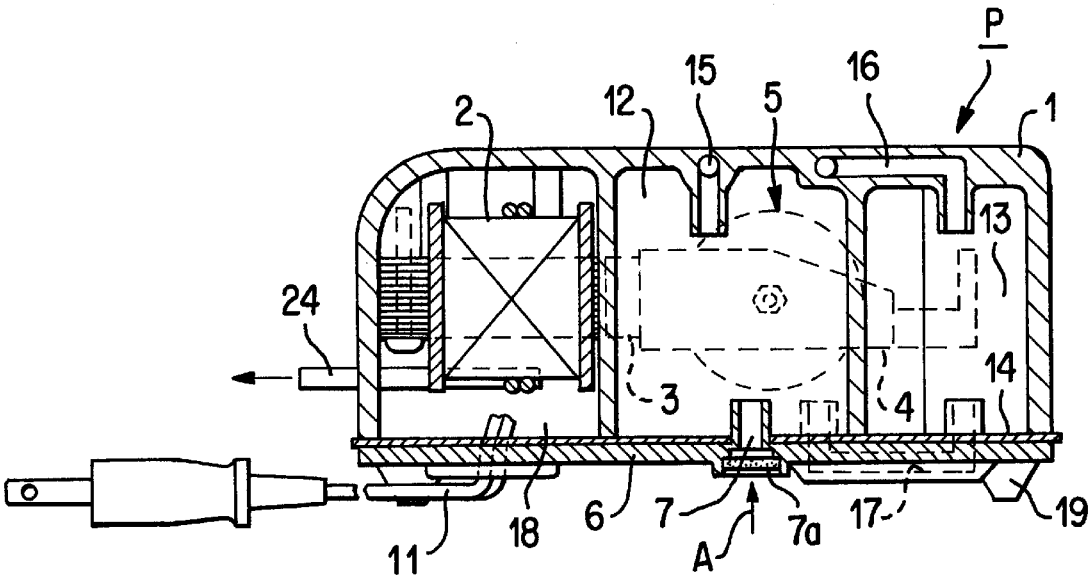
FIG. 3 is a cross sectional view taken along the line 3—3 of FIG. 1.

Referring to FIGS. 2 and 3, the air pump P operates in the following manner. When an AC voltage is applied to electromagnet 2 to vibrate arm 4, the arm alternately moves diaphragm member 5*a* toward and away from member 5*d* to alternately increase and decrease the volume of chamber 5*e*. As the volume is increased, the pressure in the chamber decreases and becomes less than the pressure in the air suction passage 15 so that inlet valve 5*b* opens. Air A is then drawn or sucked into chamber 5*e* from the sucked air noise reduction chamber 12 via air passage 15 and opening 8 while replacement air from outside the casing is drawn into chamber 12 via the air inlet opening 7 in the cover 6.

During the interval that air is being sucked into chamber 5*e* from chamber 12, the pressure in discharged air passage 16 is greater than the pressure in the chamber 5*e* and holds discharge valve 5*c* closed.

As the volume of chamber 5*e* is increased, the pressure in the chamber increases and becomes greater than the pressure in the air discharge passage 16 so that discharge valve 5*c* opens. Air compressed in chamber 5*e* is discharged from the chamber via opening 9 and flows through discharged air passage 16 to the discharged air noise reduction chamber 13. Entry of the air into chamber 13 forces air already present in the chamber out of the chamber through the discharged air connecting passage 17 in the cover 6 and into the air pump chamber 18. Air in chamber 18 is discharged from the pump through an air outlet such air outlet pipe 24 and may be conveyed to water in a tank via a flexible hose having a distal end immersed in the water.

During the interval that air is being discharged from chamber 5*e*, the pressure in the chamber is greater than the pressure in air suction passage 15 and holds the inlet valve 5*b* closed.

The chambers 12 and 13 greatly reduce the noise produced by operation of the diaphragm pump 5, particularly the noise resulting from actuation of the inlet valve 5*b* and discharge valve 5*c*, before this noise can be transferred to the environment surrounding pump P. The sound waves comprising the noise are propagated through the air in air passages 15 and 16 toward the sucked air noise reduction chamber 12 and the discharged air noise reduction chamber 13. At the openings 34 and 36, the propagation paths expand greatly so that the continuity of the air flow is cut off and the sound is greatly reduced within the chambers. Thus, leakage of noise to the exterior of pump P (via air inlet 7 and air outlet 24 for example) is greatly reduced.

Furthermore, since the sealing material 14 permits an airtight seal between the main casing body 1 and cover 6, and the air inlet 7 is filled with a filter 7*a* made of wool or synthetic resin fiber, the noise produced in the air pump chamber 18 due to the vibration of the pump driving section (electromagnet, vibrator, and diaphragm 5*a*) is mostly confined to the chamber so that it does not leak into the environment surrounding pump P.

In a practical embodiment of the pump shown in FIGS. 1–6, the capacity (rate of air discharge) of the pump P may be about 1000 cc/min, the inner diameter of the air outlet pipe about 3 mm, and the total inner volume of the main casing body 1 about 180 cc. The volume of 180 cc may be divided into about 125 cc for the air pump chamber 18, about 25 cc for the sucked air noise reduction chamber 12 and about 30 cc for the discharged air noise reduction chamber 13.

The volumes of the chambers may vary. Since the chambers 12 and 13 function to reduce noise by expansion, their efficiency in performing this function increases, up to a point, as their inner volumes are made larger. The noise can be reduced sufficiently if the inner volumes of these chambers are about ⅕ to ⅛ of the total inner volume of the main casing body 1.

Various modification may be made in the embodiment shown in FIGS. 1–6. The discharged air in the discharged air noise reduction chamber 13 need not be passed through the discharged air connecting passage 17 and air pump chamber 18 to reach the air outlet pipe 24. Instead, the outlet pipe may connect directly into chamber 13 so that discharged air passes directly from chamber 13 to the exterior of the pump. This eliminates the need for the air passage 17. In this case the inside of the noise reduction chamber 13 may be filled up with a filter made of glass fiber or another material for dispersing sound waves.

In further modifications, the air pump chamber 18 may also serve as the sucked air noise reduction chamber. In this case a connecting air passage connects chambers 12 and 18 and an air passage connects one or the other of the chambers to the opening 8 depending on whether air inlet 7 is positioned such that air enters chamber 12 or chamber 18. If air enters chamber 18 from air inlet 7 it passes through chamber 18, the connecting air passage, and chamber 12 to the opening 8 at the inlet of diaphragm pump 5. On the other hand, if air enters chamber 12 from air inlet 7 it passes through the chamber 12, the connecting air passage, and chamber 18 to the opening 8. When modified in this way the discharged air must be discharged directly from chamber 13, as opposed to being discharged through chamber 18.

Figure 8:
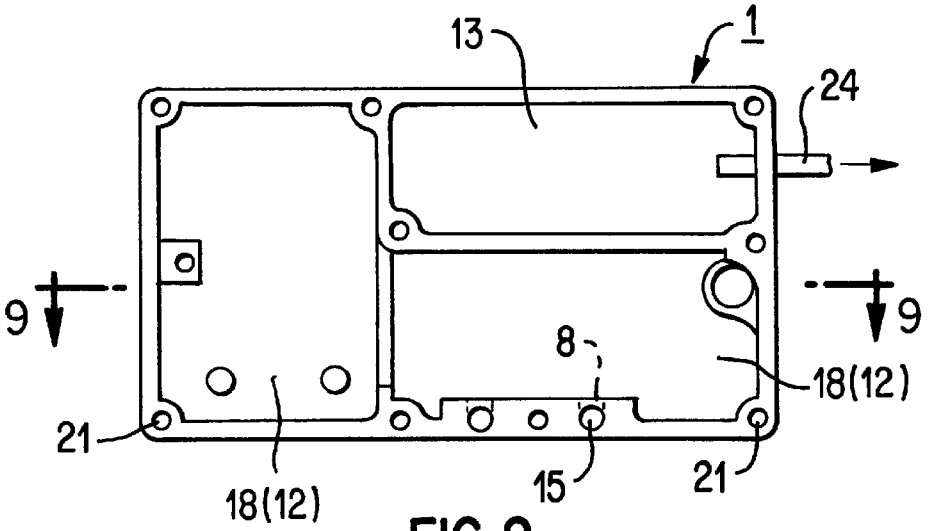
FIG. 8 is a bottom view of the main casing body of an air pump according to a second embodiment.
Figure 9:
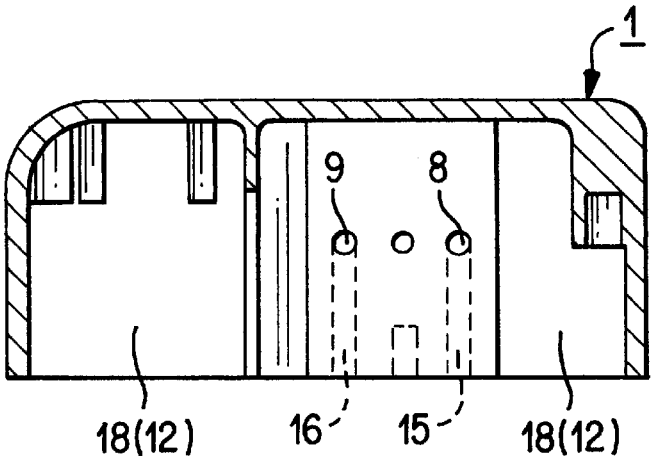
FIG. 9 is a cross sectional view taken along 9—9 of FIG. 8.
Figure 10:
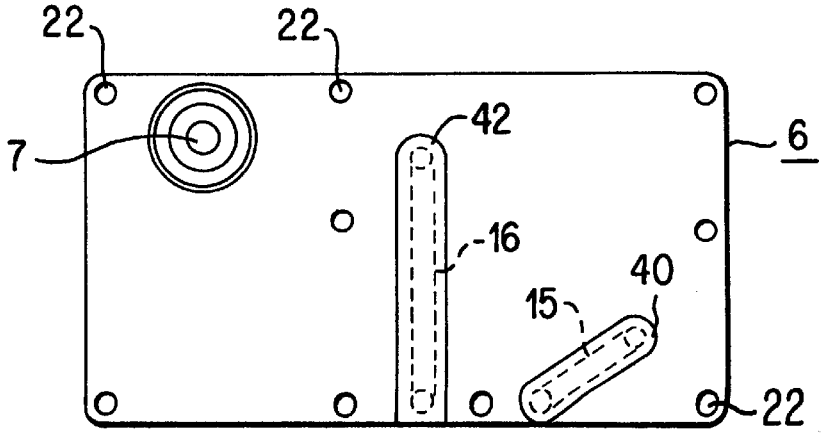
FIG. 10 is a bottom view of the casing cover of the air pump according to the second embodiment.

FIGS. 8–10 show a second embodiment of the invention wherein the interior of the main casing body 1 is divided into only two sections or chambers, namely an air pump chamber 18 and a discharged air noise reduction chamber 13. Region 12 forms part of the air pump chamber 18 and in this embodiment the chamber 18 serves the functions of both the air pump chamber 18 and the sucked air noise reduction chamber 12 of the first embodiment.

The second embodiment has an electromagnet 2, vibrator arm 4 and diaphragm pump 5. These elements are not shown in FIGS. 8–10 since they all operate in the same way as described with respect to the first embodiment.

In the second embodiment, the air suction passage 15 and the air discharge passage 16 are formed partly inside the wall of the cover 6 and partly within a side wall of the main casing body 1. The air inlet 7 is positioned on cover 6 such that when the cover is secured to the main casing body the air inlet permits air from the exterior of the pump P to enter the air pump chamber 18.

Sucked air travels through air inlet 7, chamber 18, opening 40 (FIG. 10), sucked air passage 15 and opening 8 to enter the pump chamber 5*e* (FIG. 3) as the chamber is expanded. As the chamber volume is reduced, air is discharged from the chamber to air outlet pipe 24 via opening 9, discharged air passage 16, opening 42 and chamber 13.

As described previously with respect to the first embodiment, noise or sound waves generated during operation of the pump are propagated from the pump chamber 5*e* through openings 8 and 9 and passages 15 and 16. The sound waves are dispersed and the noise is reduced when the sound waves pass from passages 15 and 16 through openings 40 and 42 to enter the larger volume of chamber 18 or 13. Noise reduction may be enhanced by filling the interior of the discharged air noise reduction chamber 13 with a noise filter material such as glass fiber, as illustrated at 38 in FIG. 5.

In a variation of the second embodiment, the air pump chamber 18 may serve as the air pump chamber and discharged air noise reduction chamber, and the chamber 13 may serve as the sucked air noise reduction chamber. In this variant air passages 15 and 16 extend from openings 8 and 9, respectively, to openings into chambers 13 and 18, respectively, the air inlet 7 admits air into chamber 13, and the air outlet pipe 24 connects with chamber 18.

Figure 11:
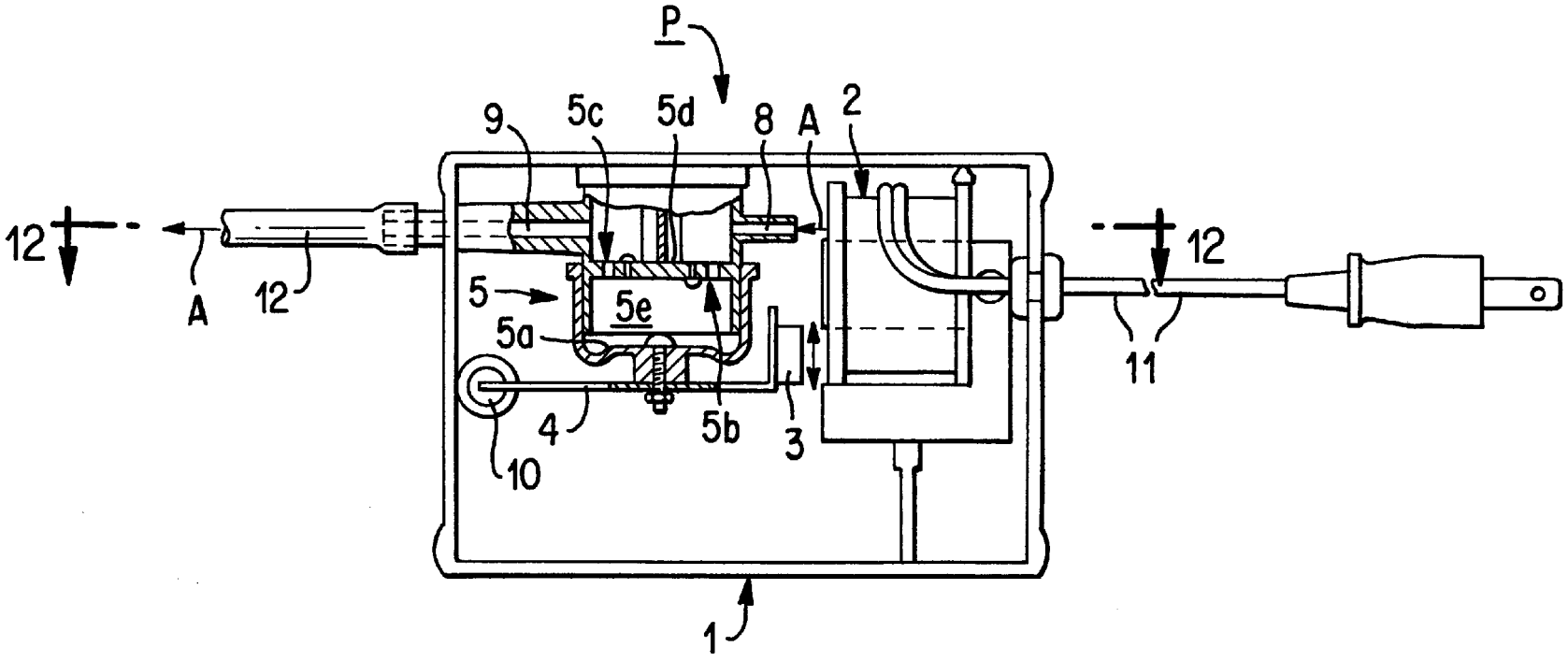
FIG. 11 PRIOR ART
FIG. 11 is a bottom view of a conventional air pump with the bottom cover removed.
Figure 12:
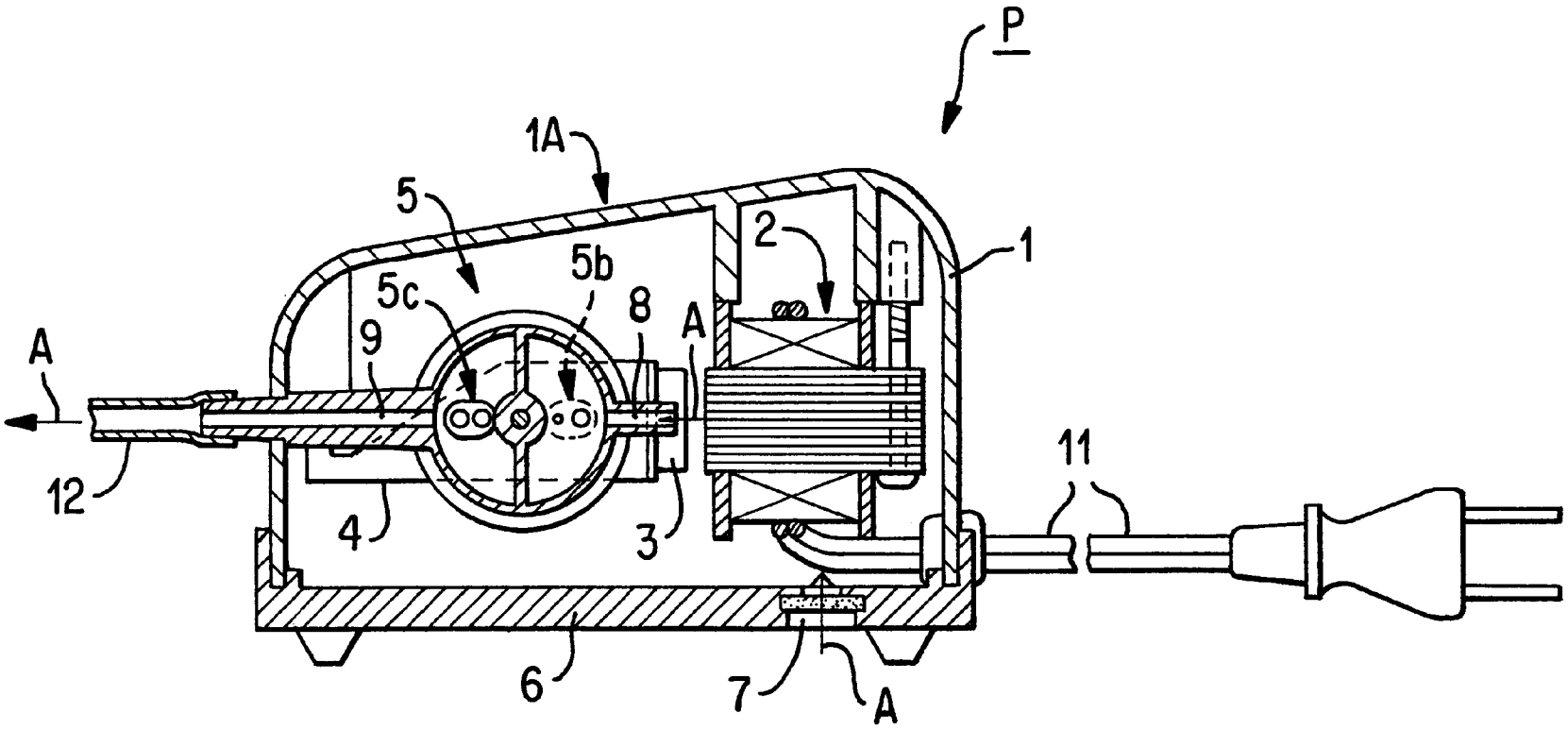
FIG. 12 PRIOR ART
FIG. 12 is a cross sectional view taken along the line 12—12 of FIG. 11.
Figure 13:
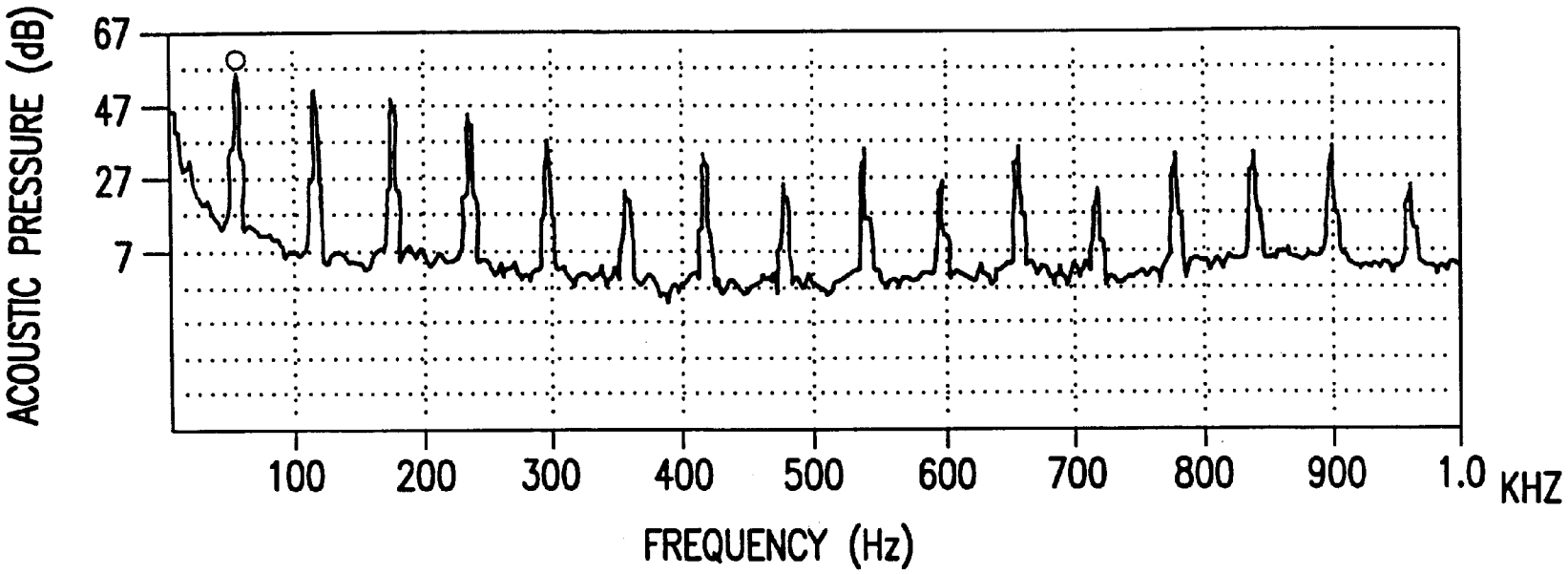
FIG. 13 is a diagram of the measured noise of a conventional unsealed air pump; and, FIG. 14 is a diagram of the measured noise of a conventional sealed air pump.
Figure 14:
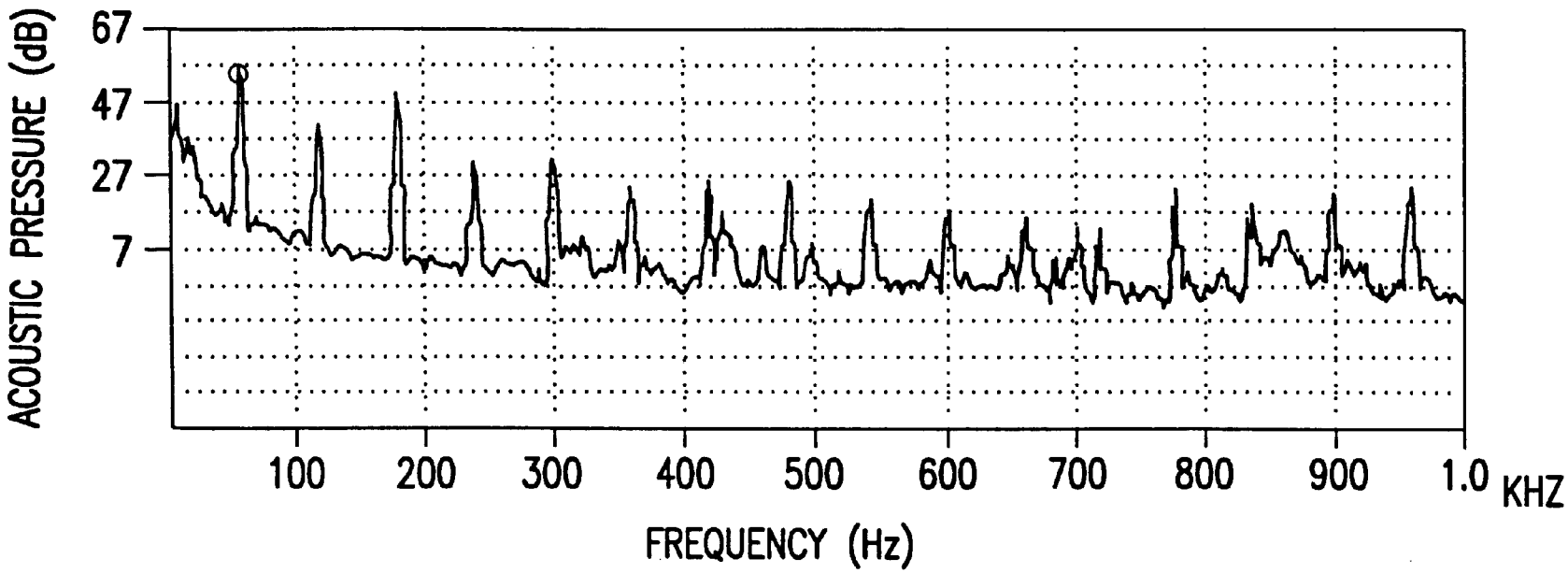

Tests were conducted to determine the noise characteristics of a pump having a main casing body as described with reference to the first embodiment shown in FIGS. 1–6 and a conventional unsealed air pump having a main casing body as described with reference to FIGS. 11 and 12. In these tests, the two pumps had identical electromagnets 2, vibrators and diaphragm pumps 5. The total volume of each pump, measured by the outside dimensions, was the same. The opening at the discharge side of the conventional unsealed pump was provided with an expansion type silencer having a capacity of about 15 cc. Noise measurements were made on both pumps in the same noiseless room using the same measurement apparatus.

Figure 7:
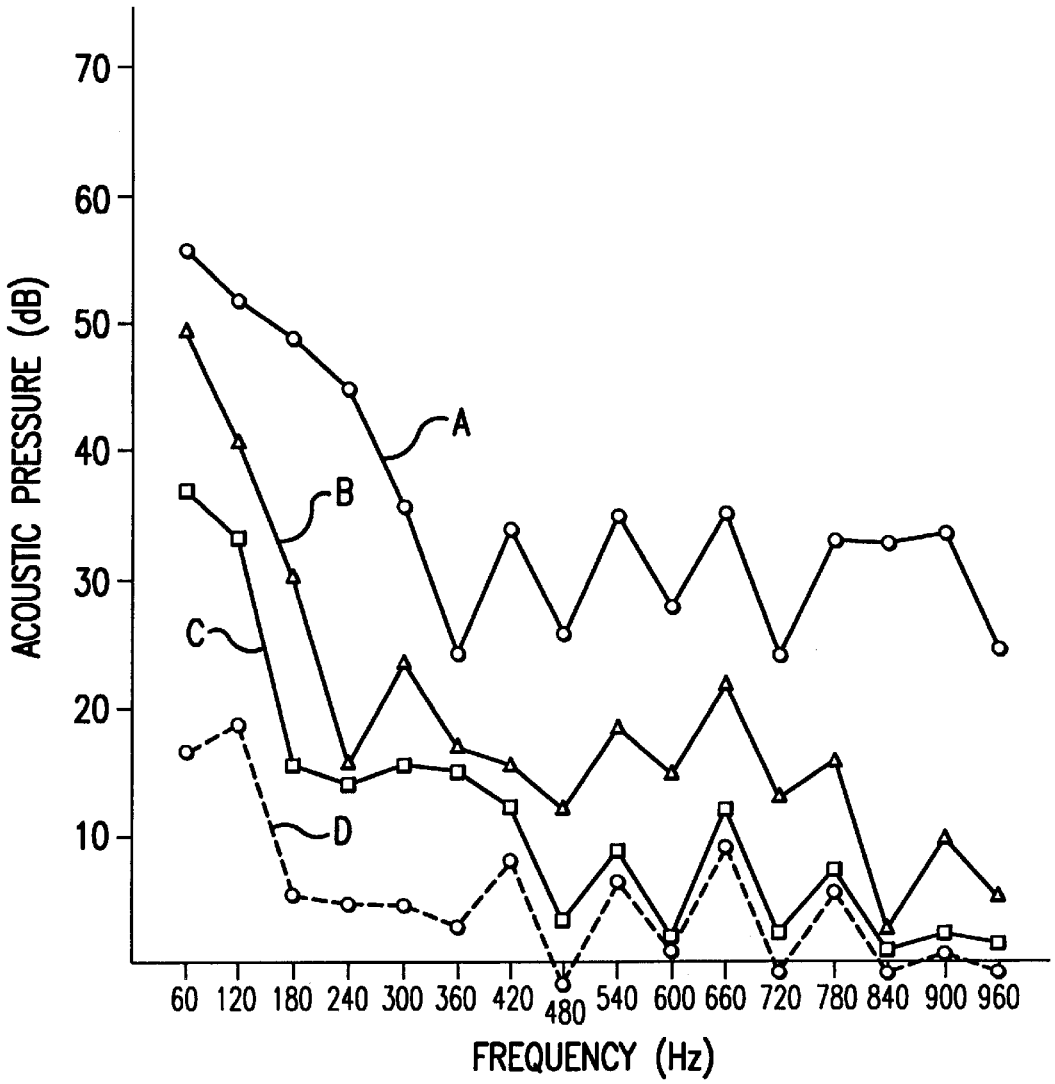
FIG. 7 is a graph illustrating the noise characteristics of a pump according to the present invention and a conventional unsealed air pump.

The test results are shown in FIG. 7 wherein curve A represents a measured F-characteristic of the conventional unsealed pump and curve B represents the same characteristic of the present invention, both measurements being made with the microphone of the measurement apparatus spaced 15 cm from the pump. The F-characteristic is a flat characteristic and is a measure of the noise as indicated by physical acoustic pressure. These curves illustrate that the F-characteristic of the present invention is much smaller than that of the conventional unsealed pump over the entire range of frequencies, even when the unsealed pump is provided with an expansion type silencer at its output opening.

Curves C and D show the F-characteristic and A-characteristic, respectively, of the air pump of the present invention, the measurements being made with a spacing of 50 cm between the microphone and the air pump. The A-characteristic is important because it provides an indication of the noise which is actually heard by a person. For example, in a bedroom, if a noise is of not more than 30 dB in the A-characteristic, the noise will not bother a person so as to prevent or disturb sleep.

From curve D it is seen that the noise produced by an air pump according to the present invention exhibits an A-characteristic having an average value of approximately 15 to 20 dB in the frequency range of not more than 200 Hz and 5 to 10 dB in the high frequency range of not less than 200 Hz. As a result, even when the air pump is operated in an environment having low background noise, such as in a quiet bedroom at night, the noise produced by the pump is hardly noticeable.

From the foregoing description it is seen that the present invention significantly reduces the noise of an air pump without requiring special parts such as vibration-proof mounts and/or a silencer connected to the pump outlet. Although preferred embodiments of the invention and variations or modifications thereof have been specifically described herein, other modifications falling within the scope of the appended claims will be apparent.

I claim:

1. An air pump in which an electromagnet, a vibrator to which a magnetic material or a permanent magnet is fixed and a diaphragm pump which is driven by the vibrator are provided in a main casing body, wherein when the diaphragm pump is driven by an electromagnetic force of the electromagnet through the vibrator, air introduced into the main casing body is sucked into a diaphragm chamber of the diaphragm pump through an air suction opening, and air in the diaphragm chamber is discharged to the outside of the main casing body through an air discharge opening, the air pump being characterized in that:

an inside space of the main casing body is divided into three chambers, namely, a sucked air noise reduction chamber, a discharged air noise reduction chamber and an air pump chamber;

a side of the main casing body is substantially sealed except for an air inlet and an air outlet;

air introduced from the outside of the main casing body through the air inlet into the sucked air noise reduction chamber is sucked into the diaphragm chamber through an air suction passage formed on a wall surface of the main casing body; and, air in the diaphragm chamber is discharged into the discharged air noise reduction chamber through an air discharge passage formed on the wall surface of the main casing body to the outside of the main casing body from the discharged air noise reduction chamber.

2. The air pump of claim 1, wherein the air pump chamber is connected to the sucked air noise reduction chamber, and the air sucked into the air pump chamber is introduced into the air suction passage of the diaphragm chamber through one of the group of chambers consisting of the sucked air noise reduction chamber and the air pump chamber.

3. The air pump of claim 1, wherein the interior of the casing body is divided into three chambers by divider walls which protrude in the downward direction from the ceiling wall of the casing body.

4. An air pump in which an electromagnet, a vibrator to which a magnetic material or a permanent magnet is fixed and a diaphragm pump which is driven by the vibrator are provided in a main casing body, wherein when the diaphragm pump is driven by an electromagnetic force of the electromagnet through the vibrator, air introduced into the main casing body is sucked into a diaphragm chamber of the diaphragm pump through an air suction opening, and air in the diaphragm chamber is discharged to the outside of the main casing body through an air discharge opening, the air pump being characterized in that:

an inside space of the main casing body is divided into three chambers, namely, a sucked air noise reduction chamber, a discharged air noise reduction chamber and an air pump chamber;

a side of the main casing body is substantially sealed except for an air inlet and an air outlet;

air introduced from the outside of the main casing body through the air inlet into the sucked air noise reduction chamber is sucked into the diaphragm chamber through the air suction opening of the diaphragm pump in the air pump chamber; and, the air is led from the discharged air noise reduction chamber into the air pump chamber and subsequently from the air pump chamber to the outside of the main casing body.

5. The air pump of claim 4, wherein the air is led from the discharged air noise reduction chamber through an air discharge connecting passage formed inside a cover body into the air pump chamber.

* * * * *